US007208746B2

(12) United States Patent
Koshelev et al.

(10) Patent No.: US 7,208,746 B2
(45) Date of Patent: Apr. 24, 2007

(54) RADIATION GENERATING DEVICE, LITHOGRAPHIC APPARATUS, DEVICE MANUFACTURING METHOD AND DEVICE MANUFACTURED THEREBY

(75) Inventors: Konstantin Nikolaevitch Koshelev, Troitsk (RU); Vladimir Vitalevitch Ivanov, Moscow (RU); Evgenii Dmitreevitch Korob, Troitsk (RU); Givi Georgievitch Zukavishvili, Troitsk (RU); Robert Rafilevitch Gayazov, Troitsk (RU); Vladimir Mihailovitch Krivtsum, Troitsk (RU)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 10/890,381

(22) Filed: Jul. 14, 2004

(65) Prior Publication Data

US 2006/0011864 A1 Jan. 19, 2006

(51) Int. Cl.
*H01J 65/04* (2006.01)

(52) U.S. Cl. ..... 250/492.2; 250/504 R; 250/493.1; 378/119; 355/53

(58) Field of Classification Search ..... 250/504 R, 250/492.2, 493.1; 378/119; 315/111.21; 355/53, 68

See application file for complete search history.

(56) References Cited

U.S. PATENT DOCUMENTS 6,002,744 A 12/1999 Hertz et al.
6,567,499 B2 * 5/2003 McGeoch ..... 378/119
6,714,624 B2 * 3/2004 Fornaciari et al. ..... 378/119
6,967,341 B2 * 11/2005 Neff et al. ..... 250/504 R
2005/0178985 A1 * 8/2005 McGeoch ..... 250/504 R

FOREIGN PATENT DOCUMENTS

GB 265636 5/1928
WO 02/102122 A1 12/2002

OTHER PUBLICATIONS

Buijsse B., A keV-electron-based tabletop soft X-ray source, Philips Research Laboratories, vol. 4502, (2001), pp. 74-81.
Korean Office Action issued in Korean Application No. 10-2005-0063573 dated Aug. 28, 2006.

* cited by examiner

*Primary Examiner*—Kiet T. Nguyen
(74) *Attorney, Agent, or Firm*—Pillsbury Winthrop Shaw Pittman, LLP

(57) ABSTRACT

A device for generating radiation source based on a discharge includes a cathode and an anode. The cathode and anode material are supplied in fluid state. The material forms a plasma pinch when the device is in use. Optionally, nozzles may be used to supply the material. The cathode and/or anode may form a flat surface. The trajectories of the material may be elongated. A laser may be used to cause the discharge more easily. The laser may be directed on the anode of cathode or on a separate material located in between the anode and cathode.

9 Claims, 4 Drawing Sheets

RADIATION GENERATING DEVICE, LITHOGRAPHIC APPARATUS, DEVICE MANUFACTURING METHOD AND DEVICE MANUFACTURED THEREBY

BACKGROUND OF THE INVENTION

1. Field of the Invention

The present invention relates to a radiation source, a lithographic apparatus, a device manufacturing method and a device manufactured thereby.

2. Description of the Related Art

A lithographic apparatus is a machine that applies a desired pattern onto a target portion of a substrate. Lithographic apparatus can be used, for example, in the manufacture of integrated circuits (ICs). In that circumstance, a patterning device, such as a mask, may be used to generate a circuit pattern corresponding to an individual layer of the IC, and this pattern can be imaged onto a target portion (e.g. including part of one or several dies) on a substrate (e.g. a silicon wafer) that has a layer of radiation-sensitive material (resist). In general, a single substrate will contain a network of adjacent target portions that are successively exposed. Known lithographic apparatus include steppers, in which each target portion is irradiated by exposing an entire pattern onto the target portion at once, and scanners, in which each target portion is irradiated by scanning the pattern through the projection beam in a given direction (the "scanning" direction) while synchronously scanning the substrate parallel or anti-parallel to this direction. In a lithographic apparatus as described above a device for generating radiation or radiation source will be present.

In a lithographic apparatus the size of features that can be imaged onto a substrate is limited by the wavelength of the projection radiation. To produce integrated circuits with a higher density of devices, and hence higher operating speeds, it is desirable to be able to image smaller features. While most current lithographic projection apparatus employ ultraviolet light generated by mercury lamps or excimer lasers, it has been proposed to use shorter wavelength radiation of around 13 nm. Such radiation is termed extreme ultraviolet, also referred to as XUV or EUV, radiation. The abbreviation 'XUV' generally refers to the wavelength range from several tenths of a nanometer to several tens of nanometers, combining the soft x-ray and vacuum UV range, whereas the term 'EUV' is normally used in conjunction with lithography (EVL) and refers to a radiation band from approximately 5 to 20 mn, i.e. part of the XUV range.

Two main types of XUV radiation generating devices or sources are currently being pursued, a laser-produced plasma (LPP) and a discharge-produced plasma (DPP). In an LPP source, one or more pulsed laser beams are typically focused on a jet of liquid or solid to create a plasma that emits the desired radiation. The jet is typically created by forcing a suitable material at high speed through a nozzle. Such a device is described in U.S. Pat. No. 6,002,744, which disloses an LPP EUV source including a vacuum chamber into which a jet of liquid is injected using a nozzle.

In general, LPP sources have several advantages compared to DPP sources. In LPP sources, the distances between the hot plasma and the source surfaces are relatively large, reducing damage to the source components and thus reducing debris production. The distances between the hot plasma and the source surfaces are relatively large, reducing the heating of these surfaces, which in turn reduces the need for cooling and reduces the amount of infra-red radiation emitted by the source. The relatively open geometry of the construction allows radiation to be collected over a wide range of angles, increasing the efficiency of the source.

In contrast, a DPP source generates plasma by a discharge in a substance, for example a gas or vapor, between an anode and a cathode, and may subsequently create a high-temperature discharge plasma by Ohmic heating caused by a pulsed current flowing through the plasma. In this case, the desired radiation is emitted by the high-temperature discharge plasma. Such a device is described in European Patent Application 03255825.6, filed Sep. 17, 2003 in the name of the applicant. This application describes a radiation source providing radiation in the EUV range of the electromagnetic spectrum (i.e. of 5–20 nm wavelength). The radiation source includes several plasma discharge elements, and each element includes a cathode and an anode. During operation, the EUV radiation is generated by creating a pinch as described in FIGS. 5A to 5E of EP 03255825.6. The application discloses the triggering of the pinch using an electric potential and/or irradiating a laser beam on a suitable surface. The laser used has typically a lower power than the laser(s) used in an LPP source.

In general, however, DPP sources have several advantages compared to LPP sources. In DPP sources, the efficiency of the source is higher, approximately 0.5% for a DPP compared to 0.05% for an LPP. DPP sources also have a lower cost and require fewer, less expensive part replacements.

SUMMARY OF THE INVENTION

It is an aspect of the present invention to provide a DPP radiation generating device or source which combines the advantages of a DPP radiation generating device or source with many of the advantages of an LPP source. The source is especially suitable for generating EUV radiation, but may be used to generate radiation outside the EUV range, for example X-rays.

According to an embodiment of the present invention, a radiation generating device includes a first nozzle configured to provide a first jet of a first material, wherein the first jet of the first material is configured to function as a first electrode; a second electrode; and an ignition source configured to trigger a discharge between the first electrode and the second electrode.

As used herein, "electrode" is meant to refer to an anode and/or cathode. The radiation generating device according to the present invention provides less electrode erosion, meaning a stable recovering electrode configuration, i.e. a stable continuous source of radiation. No extra measures are needed to remove the generated heat since the jet takes care of this. This will result in a more stable electrode geometry. The jet may include a material in a fluid state or a carrier fluid that contains relatively small material in a solid state. It desirable to use a laser for triggering the discharge as both a more exact definition of the location of the discharge is possible in this way and a higher conversion efficiency (CE) is obtained in comparison with a radiation source induced by a voltage pulse on a main or an additional trigger electrode. The combination of a stable electrode geometry and a more exact definition of the location of the discharge results in a radiation source which emits radiation that is relatively constant in power and more homogeneous. The nozzles are readily available and they can be effectively cooled by the electrode materials. Presently available prototypes use a flow of fluorine containing material. Fluorine, however, cannot be used for cooling purposes due to the small evaporation heat of fluorine as compared to, for example, Sn, In or Li. The latter may be employed in the present invention.

In a further embodiment, the ignition source is configured to trigger the discharge by evaporation of the first material. In this embodiment, the discharge material and the electrode material is the same. Thus, no additional material is needed.

In a further embodiment, the device includes a second nozzle, the nozzle being arranged to provide a second jet, the second jet including a second material, the second jet being configured to function as the second electrode and the ignition source is configured to trigger the discharge by evaporation of at least one of the first material and the second material. As both the anode and cathode are formed by a jet, the radiation generating device deals even more effectively with heat removal and will have a more stable geometry. This embodiment also provides the features discussed above.

In a further embodiment, the device includes a second nozzle, the nozzle being configured to provide a second jet and the second jet is configured to function as the second electrode and the device further includes a substance of a third material, and the ignition source is arranged to trigger the discharge by evaporation of the third material. This provides a choice of material for the anode and/or cathode that is different from this third (discharge) material.

In a further embodiment, the first nozzle is configured to provide the first material substantially along a straight line trajectory. Possible debris particles originating from the electrode will then have an impulse along this straight line trajectory. The generated radiation, however, is more or less isotropic and a substantial amount of the radiation will not be directed along the straight line trajectory. As a consequence most radiation will include less debris. In a further embodiment, the device includes at least one further nozzle arranged to provide at least one further jet, the first jet and the at least one further jet being configured to provide a substantially flat shaped electrode. This offers advantageously a flat (height relatively small compared to width and length) electrode surface for effective laser triggering, and a small inductance of the electrode system, which can allow working with a small amount of electrical energy in one pulse at an allowable overall consumption of material of the jets.

In a further embodiment, the first material includes at least one of tin (Sn), Indium (In), Lithium (Li) and any combination thereof. These materials have proven to perform well in practice.

In another embodiment of the present invention, a lithographic apparatus includes a device for generating radiation, the device including a first nozzle configured to provide a first jet of a first material, wherein the first jet of the first material is configured to function as a first electrode; a second electrode; and an ignition source configured to trigger a discharge between the first electrode and the second electrode. The lithographic apparatus also includes an illumination system configured to provide a beam of radiation from the radiation generated by the device for generating radiation; a support configured to supporting a patterning device, the patterning device configured to impart the beam of radiation with a pattern in its cross-section; a substrate table configured to hold a substrate; and a projection system configured to project the patterned beam onto a target portion of the substrate.

In still another embodiment of the present invention, a device manufacturing method includes generating radiation by use of a device comprising a first nozzle configured to provide a first jet of a first material, wherein the first jet of the first material is configured to function as a first electrode, a second electrode, and an ignition source configured to trigger a discharge between the first electrode and the second electrode; providing a beam of radiation from the generated radiation; patterning the beam of radiation with a pattern in its cross-section; and projecting the patterned beam of radiation onto a target portion of a substrate.

In a yet still further embodiment of the present invention, a device is manufactured by the device manufacturing method.

Although specific reference may be made in this text to the use of lithographic apparatus in the manufacture of ICs, it should be understood that the lithographic apparatus described herein may have other applications, such as the manufacture of integrated optical systems, guidance and detection patterns for magnetic domain memories, liquid-crystal displays (LCDs), thin-film magnetic heads, etc. It should be appreciated that, in the context of such alternative applications, any use of the terms "wafer" or "die" herein may be considered as synonymous with the more general terms "substrate" or "target portion", respectively. The substrate referred to herein may be processed, before or after exposure, in for example a track (a tool that typically applies a layer of resist to a substrate and develops the exposed resist) or a metrology or inspection tool. Where applicable, the disclosure herein may be applied to such and other substrate processing tools. Further, the substrate may be processed more than once, for example in order to create a multi-layer IC, so that the term substrate used herein may also refer to a substrate that already contains multiple processed layers.

The terms "radiation" and "beam" used herein encompass all types of electromagnetic radiation, including ultraviolet (UV) radiation (e.g. having a wavelength of 365, 248, 193, 157 or 126 nm) and extreme ultra-violet (EUV) radiation (e.g. having a wavelength in the range of 5–20 nm), as well as particle beams, such as ion beams or electron beams.

The term "patterning device" used herein should be broadly interpreted as referring to a device that can be used to impart a beam of radiation with a pattern in its cross-section such as to create a pattern in a target portion of the substrate. It should be noted that the pattern imparted to the projection beam may not exactly correspond to the desired pattern in the target portion of the substrate. Generally, the pattern imparted to the projection beam will correspond to a particular functional layer in a device being created in the target portion, such as an integrated circuit.

Patterning device may be transmissive or reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions; in this manner, the reflected beam is patterned.

The support supports, e.g. bares the weight of, the patterning device. It holds the patterning device in a way depending on the orientation of the patterning device, the design of the lithographic apparatus, and other conditions, for example whether or not the patterning device is held in a vacuum environment. The support can be using mechanical clamping, vacuum, or other clamping techniques, for example electrostatic clamping under vacuum conditions.

The support may be a frame or a table, for example, which may be fixed or movable as required and which may ensure that the patterning device is at a desired position, for example with respect to the projection system. Any use of the terms "reticle" or "mask" herein may be considered synonymous with the more general term "patterning device."

The term "projection system" used herein should be broadly interpreted as encompassing various types of projection system, including refractive optical systems, reflective optical systems, and catadioptric optical systems, as appropriate for example for the exposure radiation being used, or for other factors such as the use of an immersion fluid or the use of a vacuum. Any use of the term "lens" herein may be considered as synonymous with the more general term "projection system."

The illumination system may also encompass various types of optical components, including refractive, reflective, and catadioptric optical components for directing, shaping, or controlling the projection beam of radiation, and such components may also be referred to below, collectively or singularly, as a "lens."

The lithographic apparatus may be of a type having two (dual stage) or more substrate tables (and/or two or more mask tables). In such "multiple stage" machines the additional tables may be used in parallel, or preparatory steps may be carried out on one or more tables while one or more other tables are being used for exposure.

The lithographic apparatus may also be of a type wherein the substrate is immersed in a liquid having a relatively high refractive index, e.g. water, so as to fill a space between the final element of the projection system and the substrate. Immersion liquids may also be applied to other spaces in the lithographic apparatus, for example, between the mask and the first element of the projection system. Immersion techniques are well known in the art for increasing the numerical aperture of projection systems.

BRIEF DESCRIPTION OF THE DRAWINGS

Embodiments of the present invention will now be described, by way of example only, with reference to the accompanying schematic drawings in which corresponding reference symbols indicate corresponding parts, and in which.

DETAILED DESCRIPTION

Figure 1:
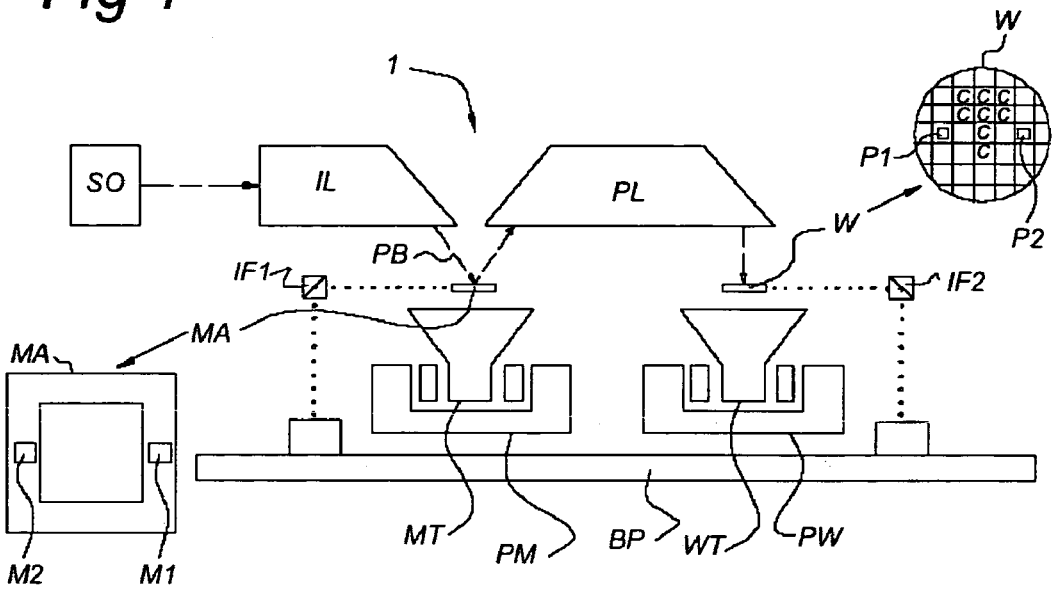
FIG. 1 depicts a lithographic apparatus according to an embodiment of the invention.

FIG. 1 schematically depicts a lithographic apparatus 1 according to an embodiment of the present invention. The apparatus 1 includes an illumination system (illuminator) IL configured to provide a beam PB of radiation, for example UV or EUV radiation. A support (e.g. a mask table) MT supports a patterning device (e.g. a mask) MA and is connected to a first positioning device PM that accurately positions the patterning device with respect to a projection system PL. A substrate table (e.g. a wafer table) WT holds a substrate (e.g. a resist-coated wafer) W and is connected to a second positioning device PW that accurately positions the substrate with respect to the projection system PL. The projection system (e.g. a reflective projection lens) PL images a pattern imparted to the beam PB by the patterning device MA onto a target portion C (e.g. including one or more dies) of the substrate W.

As here depicted, the apparatus is of a reflective type (e.g. employing a reflective mask or a programmable mirror array of a type as referred to above). Alternatively, the apparatus may be of a transmissive type (e.g. employing a transmissive mask).

The illuminator IL as known in the art receives radiation from a radiation generating device SO and conditions the radiation. The radiation generating device and the lithographic apparatus 1 may be separate entities, for example when the radiation generating device is a plasma discharge source. In such cases, the radiation generating device is not considered to form part of the lithographic apparatus and the radiation is generally passed from the radiation generating device SO to the illuminator IL with the aid of a radiation collector including, for example, suitable collecting mirrors and/or a spectral purity filter. In other cases the radiation generating device may be integral part of the apparatus, for example when the radiation generating device is a mercury lamp. The radiation generating device SO and the illuminator IL may be referred to as a radiation system.

The illuminator IL may include an adjusting device to adjust the angular intensity distribution of the beam. Generally, at least the outer and/or inner radial extent (commonly referred to as σ-outer and c-inner, respectively) of the intensity distribution in a pupil plane of the illuminator can be adjusted. The illuminator provides a conditioned beam of radiation PB having a desired uniformity and intensity distribution in its cross-section.

The beam PB is incident on the mask MA, which is held on the mask table MT. Being reflected by the mask MA, the beam PB passes through projection system PL, which focuses the beam onto a target portion C of the substrate W. With the aid of the second positioning device PW and a position sensor IF2 (e.g. an interferometric device), the substrate table WT can be moved accurately to position different target portions C in the path of the beam PB. Similarly, the first positioning device PM and a position sensor IF1 (e.g. an interferometric device) can be used to accurately position the mask MA with respect to the path of the beam PB, for example after mechanical retrieval from a mask library, or during a scan. In general, movement of the object tables MT and WT will be realized with the aid of a long-stroke module (coarse positioning) and a short-stroke module (fine positioning), which form part of the positioning devices PM and PW. However, in the case of a stepper, as opposed to a scanner, the mask table MT may be connected to a short stroke actuator only, or may be fixed. Mask MA and substrate W may be aligned using mask alignment marks M1, M2 and substrate alignment marks P1, P2.

The depicted apparatus can be used in the following modes:

1. In step mode, the mask table MT and the substrate table WT are kept essentially stationary, while an entire pattern imparted to the beam is projected onto a target portion C at once (i.e. a single static exposure). The substrate table WT is then shifted in the X and/or Y direction so that a different target portion C can be exposed. In step mode, the maximum size of the exposure field limits the size of the target portion C imaged in a single static exposure.

2. In scan mode, the mask table MT and the substrate table WT are scanned synchronously while a pattern imparted to the beam is projected onto a target portion C (i.e. a single dynamic exposure). The velocity and direction of the substrate table WT relative to the mask table MT is determined by the (de-)magnification and image reversal characteristics of the projection system PL. In scan mode, the maximum size of the exposure field limits the width (in the non-scanning direction) of the target portion in a single dynamic exposure, whereas the length of the scanning motion determines the height in the scanning direction of the target portion.

3. In another mode, the mask table MT is kept essentially stationary holding a programmable patterning device, and the substrate table WT is moved or scanned while a pattern imparted to the beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes a programmable patterning device, such as a programmable mirror array of a type as referred to above.

Combinations and/or variations on the above described modes of use or entirely different modes of use may also be employed.

Figure 2:
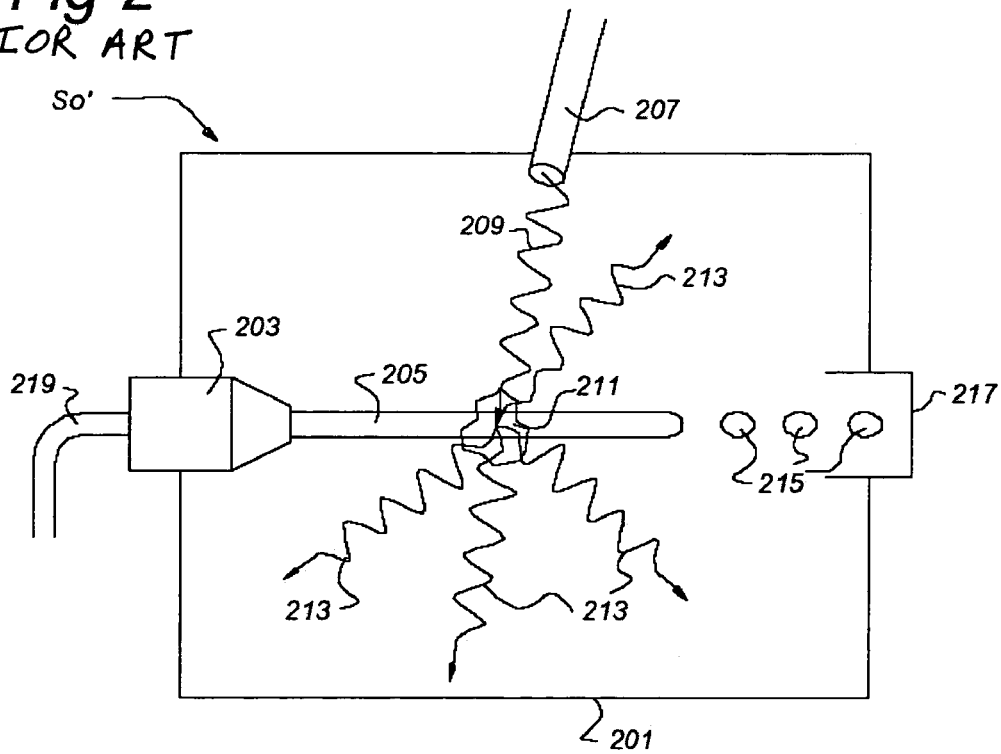
Fig 2 PRIOR ART
FIG. 2 depicts a radiation source according to the prior art.

FIG. 2 shows a radiation source SO' according to the prior art, for example as described in U.S. Pat. No. 6,002,744. The radiation source SO' includes a housing 201. In the housing 201 a nozzle 203, a laser 207 and a reservoir 217 are located. The nozzle 203 connects to a hose 219 or other supply. A jet of material 205 is supplied by the nozzle 203 in the housing 201. The laser 207 provides a beam of radiation 209 on the jet 205. Further downstream, the jet 205 disintegrates into droplets 215 which are collected by a reservoir 217. A plasma 211 is generated by the laser 207 which produces a desired type of radiation 213 (e.g. soft X-ray/EUV).

Figure 3A:
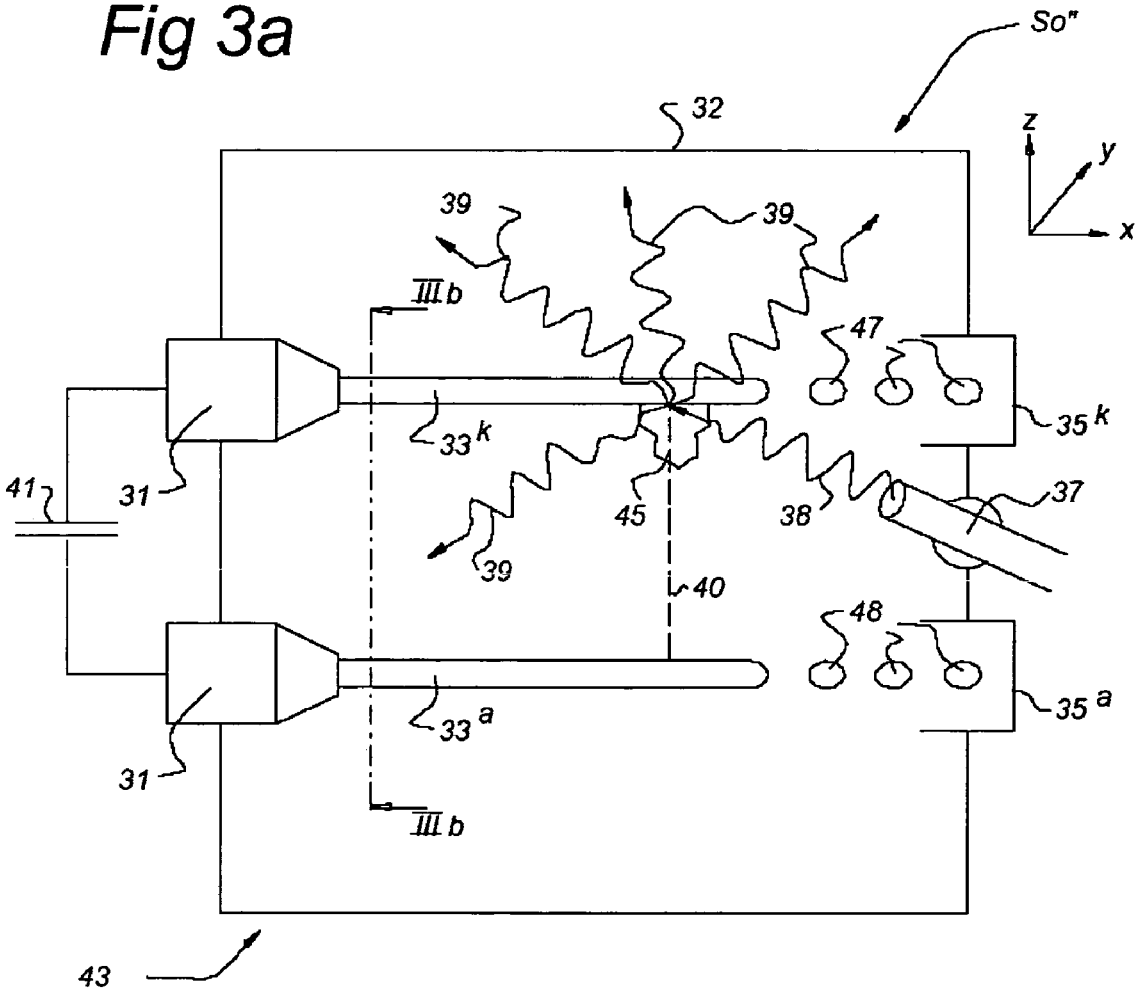
FIG. 3*a* depicts a radiation source according to an embodiment of the present invention.
Figure 3B:
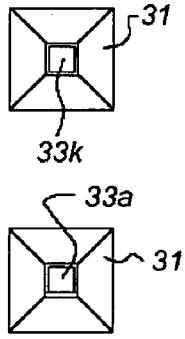
FIG. 3*b* shows a cross-section along line IIIb—IIIb of the jets in FIG. 3*a;*

Referring to FIGS. 3*a* and 3*b*, a radiation generating device SO" according to the present invention and useable with the lithographic apparatus of FIG. 1 includes a housing 32 with two nozzles 31 that are connected to a high voltage source 41 that may include a capacitor. The nozzles 31 provide small electrically conductive jets 33*a*, 33*k* of a fluid, for example including Sn, In or Li or any combination thereof. Fluid refers here to a material in the liquid state and also to tiny solid particles immersed in a fluid as carrier.

By using an electrically conductive material like Sn, In or Li or a combination thereof, the jets 33*a*, 33*k* are in electrical contact with the voltage source 41 and thus form electrodes. One of the jets 33*a* is provided with a positive voltage and functions as an anode whereas the other jet 33*k* is provided with a negative voltage and functions as a cathode. The jets 33*a*, 33*k* each end in respective reservoirs 35*a*, 35*k* where the fluid is collected. The length of jets 33*a*, 33*k* are chosen to be long enough, for example approximately 3–30 cm for 0.2–1 mm jet thickness, so that the jets 33*a*, 33*k* disintegrate in separate droplets 48, 47, respectively, close to the reservoirs 35*a*, 35*k*. This will avoid a direct electrical contact between the reservoirs 35*a*, 35*k* and the high voltage source 41. It should be appreciated that one common reservoir may be provided instead of the two separate reservoirs 35*a*, 35*k* shown in FIG. 3*a*.

A pulsed laser source 37 is provided in the housing 32. Typical parameters are: energy per pulse Q is approximately 10–100 mJ for a Sn discharge and approximately 1–10 mJ for a Li discharge, duration of the pulse $\tau$=1–100 ns, laser wavelength $\lambda$=0.2–10 μm, frequency 5–100 kHz. The laser source 37 produces a laser beam 38 directed to the jet 33*k* to ignite the conductive material of the jet 33*k*. Thereby, material of the jet 33*k* is evaporated and pre-ionized at a well defined location, i.e. the location where the laser beam 38 hits the jet 33*k*. From that location a discharge 40 towards the jet 33*a* develops. The precise location of the discharge 40 can be controlled by the laser source 37. This is desirable for the stability, i.e. homogeneity, of the radiation generating device and will have an influence on the constancy of the radiation power of the radiation generating device. This discharge 40 generates a current between the jet 33*k* and the jet 33*a*. The current induces a magnetic field. The magnetic field generates a pinch, or compression, 45 in which ions and free electrons are produced by collisions. Some electrons will drop to a lower band than the conduction band of atoms in the pinch 45 and thus produce radiation 39. When the material of the jets 33*a*, 33*k* is chosen from Sn, In or Li or any combination thereof, the radiation 39 includes large amounts of EUV radiation. The radiation 39 emanates in all directions and may be collected by a radiation collector in the illuminator IL of FIG. 1. The laser 37 may provide a pulsed laser beam 38.

Tests have shown that the radiation 39 is isotropic at least at angles to a Z-axis with an angle $\theta$=45–105°. The Z-axis refers to the axis aligned with the pinch and going through the jets 33*a*, 33*k* and the angle $\theta$ is the angle with respect to the Z-axis. The radiation 39 may be isotropic at other angles as well. Pressures p provided by the nozzles 31 follow from the well known relation $p=\frac{1}{2}\rho v^2$, where $\rho$ refers to the density of the material ejected by the nozzles and v refers to the velocity of the material. It follows that p=4–400 atm for Sn or In at a velocity v=10–100 m/s and p=0.2–20 atm for Li at a velocity v=10–100 m/s.

The nozzles 31 may have a circular cross-section of 0.3–3 mm diameter. Depending on the particular form of the nozzle 31 it is however possible to have jets 33*a*, 33*k* with a square cross-section, as shown in FIG. 3*b*, or another polygonal cross-section. In addition, it may be desirable to employ one or both jets 33*a*, 33*k* with a flat-shaped surface, as shown in FIG. 4.

Figure 4:
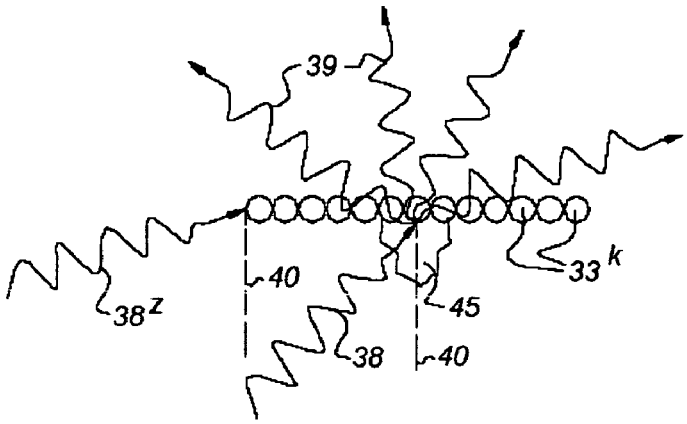
FIG. 4 depicts a cross-section of a geometry of jets in an embodiment of a radiation source according to the present invention.

FIG. 4 shows several jets 33*k* viewed in front. The jets 33*k* are located so close to each other that effectively a flat-shaped electrode surface results. This is done by mounting several nozzles 31 close to each other. A flat-shaped cathode surface may be used, but a flat-shaped anode surface is also possible. Test have shown that a flat cathode surface has a better, nearly double, conversion efficiency (CE) compared to a flat anode surface. On the other hand, a jet 33*a*, 33*k* with circular cross section may minimize the number of liquid droplets (debris) in the direction of the radiation. This is desirable when operating a radiation source in a lithographic apparatus in the EUV range of the electromagnetic spectrum. EUV radiation with limited or no debris is hard to obtain. Flat-shaped electrodes may be desirable in other respects. Two parallel flat-shaped and wide jets 33*a*, 33*k* of, for example 6 mm width by 0.1 mm thickness with 3 mm distance between them, will have a very small inductance L. This allows the use of small energy in one pulse provided by the laser 37, defined by $Q \sim \frac{1}{2} L * I^2$, where Q is the energy per pulse, for example from the capacitor 41, I is the discharge current, I being approximately 10–20 kA for Sn discharge with a good CE, and L is the inductance. L is typically 5–20 nH where the borders of this interval may typically be extended. In particular, in the case of a Li discharge, where large energy discharge pulses have a small CE, this may be desirable.

In the case of flat-shaped electrodes as shown in FIG. 4, the laser beam may also be directed to the edge of one of the jets 33*a*, 33*k*, for example the jet 33*k*, thus producing a discharge 40 between the edge of the jet (cathode) 33*k* and the edge of the anode. This is shown in FIG. 4 as a laser beam 38*z*. As a result, a nearly 2π collection angle (not shown) for radiation 39 may be obtained in this case.

One millimeter round jets 33*a*, 33*k* with a mutual distance of approximately 3–5 mm may, in principle, allow a collection angle of nearly 4π. Also, any combination of flat-shaped and round jets 33*a*, 33*k* is possible. The diameter of the jets 33*a*, 33*k* is close to that of the nozzles in the case of a round electrode.

Jets at a high velocity of approximately 10–100 m/s may be used. These velocities enable a length of stability of 0.3–3 cm that is long enough. At large distances, for example 5–10 cm from the nozzles 31, a line of droplets 47, 48 will be produced instead of jets. Therefore, there is no electrical contact between the jets 33*a*, 33*k* which are on a high voltage and the droplets 47, 48 that can be gathered in one common reservoir 35. Thin, flat jets disintegrate faster than round ones. If the jets 33*a*, 33*k* have not disintegrated upon reaching such a common reservoir 35 they must be gathered separately i.e. each in a separate reservoir 35*k*, 35*a* as shown in FIG. 3*a*, to avoid short-circuiting. It is possible to switch the voltage on only after a state has been obtained in which the jets 33*a*, 33*k* disintegrate in an appropriate manner, i.e. before reaching a common reservoir.

Although the embodiment in FIG. 3*a* shows two elongated, parallel jets 33*a*, 33*k* flowing in the same direction, the invention applies equally well to different geometries, i.e. jets 33*a*, 33*k* under an angle and/or jets 33*a*, 33*k* flowing in opposite directions. The particular geometry may have an effect on the inductance of the system though.

In the description above, the laser beam 38, also referred to as "ignition laser," is directed to the surface of the jet, and creates locally a small cloud of ionized gas. The jets 33*a*, 33*k* supply working material (plasma material), for example Sn, In, or Li, to produce the radiation 39.

Figure 5A:
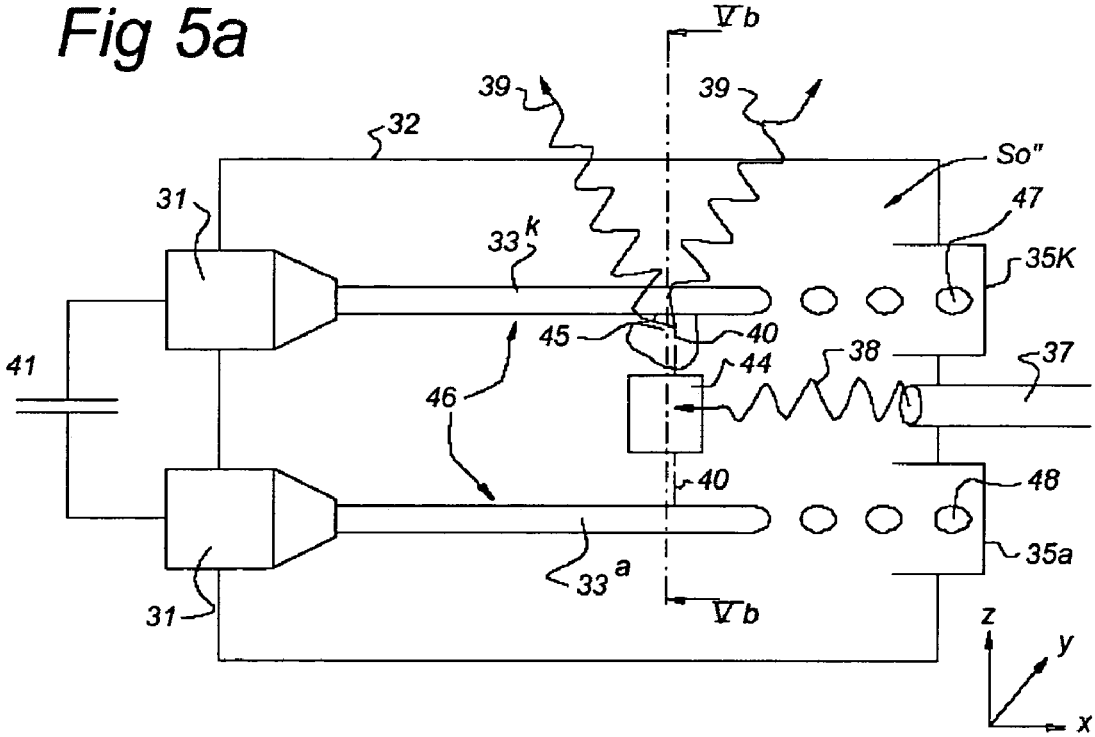
FIG. 5*a* depicts a radiation source according to another embodiment of the invention.
Figure 5B:
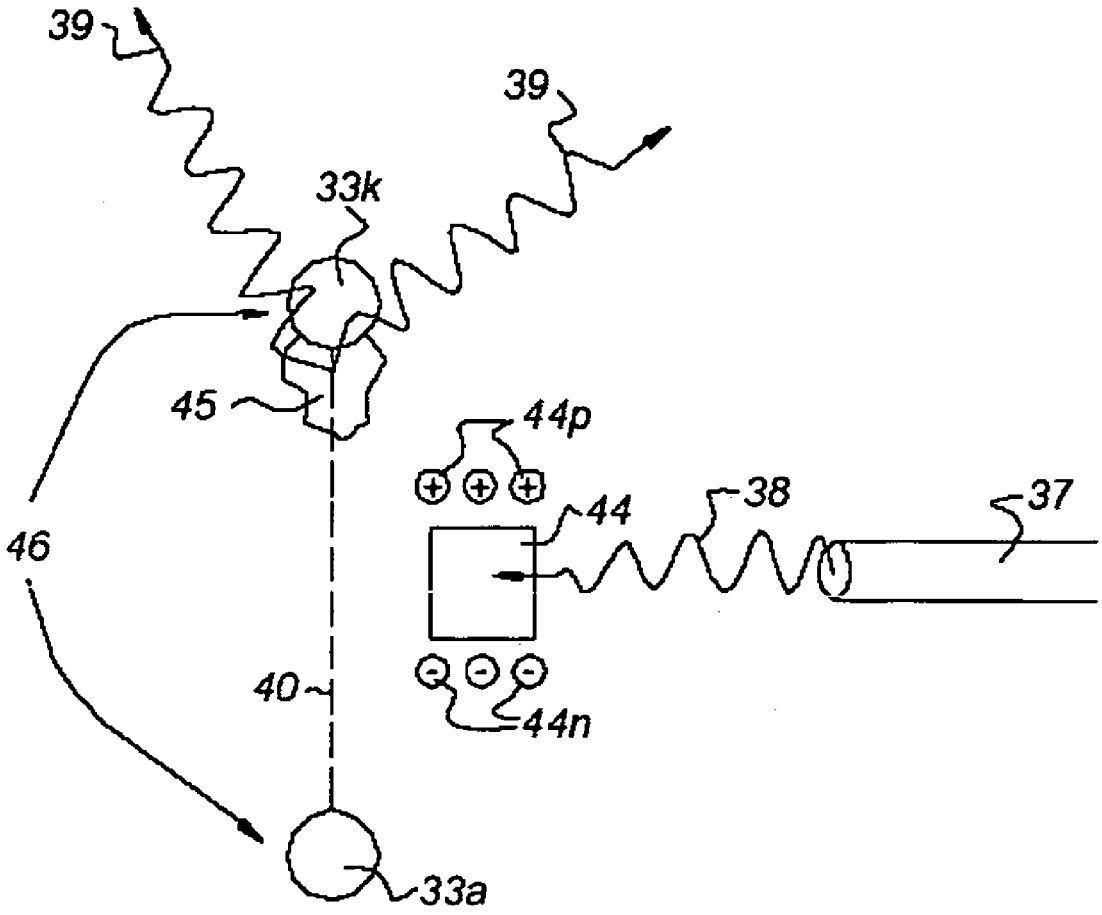
FIG. 5*b* depicts a cross-section along line Vb—Vb in FIG. 5*a*.

Referring to FIG. 5*a*, the laser beam 38 may be directed to a substance 44 located in a gap 46 between jets 33*k* and jet 33*a*. Under the influence of the laser beam 38, this substance 44 will form small evaporated, probably at least partly ionized, particles/droplets. The material of the substance 44 may be chosen the same as or different from the material of the jets 33*a*, 33*k*. The laser beam 38 will help a discharge 40 to originate substantially at a desired location. A discharge current will flow through the gap 46 between the electrodes 33*a*, 33*k* at the place of the discharge 40. A magnetic field, thus induced, causes the pinch 45. The pinch 45 will include a jet and/or particles/droplets of the material of the substance 44. The radiation 39 emanates from the pinch 45.

Referring to FIG. 5*a*, the beam 38 will ionize the substance 44 resulting in positively charged particles 44*p* and negatively charged particles 44*n*. These particles will be attracted towards the jets 33*a*, 33*k*. The discharge 40 will originate between the jets 33*a*, 33*k*, which eventually results in the formation of the pinch 45 as explained above. The substance 44 is located in the vicinity of the jets. The nozzles 31 guarantee a continuous supply of jet material, i.e. a stable electrode geometry, and the radiation 39 is highly stable in pulse energy. Any heat generated in the radiation process is continuously removed by the liquid flow of jets 33*a*, 33*k*, if its velocity is larger than, for example, approximately 10–15 m/s.

The material in the jets 33*a*, 33*k* may include droplet type debris. The nozzles 31 impart an impulse to this material and hence to the debris in a specific direction, for example along a straight line trajectory. As the radiation 39 emanates more or less isotropically, there will be a substantial amount of radiation 39 that will be substantially free of debris.

The small sizes of the jets 33*a*, 33*k* define a radiation generating device having a small size and a large collection angle. The size of the radiation generating device SO" is mainly limited by the sizes of the jets 33*a*, 33*k*. Typical dimensions for the jets 33*a*, 33*k* may be: thickness approximately 0.1–1 mm, width approximately 1–3 mm, length approximately 0.3–3 cm, gap approximately 3–5 mm. These parameters result in a relatively large collectable angle.

While specific embodiments of the invention have been described above, it will be appreciated that the invention may be practiced otherwise than as described. The description is not intended to limit the invention.

For example, in the embodiments described above, both the jets 33*k* and 33*a* are produced as a conductive fluid jet. However, the anode may be a fixed anode. However, then anode material may come in the space surrounding the source.

Ignition of the discharge between the jets 33*k* and 33*a* is described above as being triggered by a laser beam 38. However, such an ignition may be triggered by an electron beam, or any other suitable ignition source.

What is claimed is:

1. A lithographic apparatus, comprising:

a radiation generator comprising a first nozzle configured to provide a first jet of a first material wherein the first jet of the first material is configured to function as a first electrode, a second electrode, and an ignition source configured to trigger a discharge between the first electrode and the second electrode;

an illumination system configured to condition a beam of radiation from the radiation generator;

a support configured to support a patterning device, the patterning device configured to impart the beam of radiation with a pattern in its cross-section;

a substrate table configured to hold a substrate; and a projection system configured to project the patterned beam onto a target portion of the substrate.

2. An apparatus according to claim 1, wherein the ignition source is configured to trigger the discharge by evaporation of the first material.

3. An apparatus according to claim 1, further comprising:

a second nozzle configured to provide a second jet of a second material, the second jet being configured to function as the second electrode, wherein the ignition source is configured to trigger the discharge by evaporation of the first material, or the second material, or both the first material and the second material.

4. An apparatus according to claim 1, further comprising:

a second nozzle configured to provide a second jet of a second material, the second jet being configured to function as the second electrode; and a substance of a third material, wherein the ignition source is arranged to trigger the discharge by evaporation of the third material.

5. An apparatus according to claim 1, wherein the first jet comprises a length of approximately 3 cm to 30 cm and a thickness of approximately 0.2 mm to 1 mm.

6. An apparatus according to claim 1, wherein the ignition source is configured to generate a beam of laser radiation, or an electron beam, or both a beam of laser radiation and an electron beam, to trigger the discharge.

7. An apparatus according to claim 1, wherein the first nozzle is configured to provide the first material in a direction along a straight line trajectory.

8. An apparatus according to claim 7, further comprising: at least one further nozzle configured to provide at least one further jet, the first jet and the at least one further jet being arranged to provide a substantially flat shaped electrode.

9. An apparatus according to claim 1, wherein the first material comprises at least one of tin, indium, lithium and any combination thereof.

* * * * *